US011019695B1

(12) United States Patent
Peng

(10) Patent No.: US 11,019,695 B1
(45) Date of Patent: May 25, 2021

(54) METHOD OF SEQUENCING LED LIGHT STRING, SELF-SEQUENCING LED LIGHT STRING SYSTEM, AND LED LIGHT

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 0 days.

(21) Appl. No.: 16/795,531

(22) Filed: Feb. 19, 2020

(30) Foreign Application Priority Data

Dec. 18, 2019 (CN) ..... 201911307622.8

(51) Int. Cl.
*H05B 33/08* (2020.01)
*H05B 45/20* (2020.01)
*H05B 45/32* (2020.01)

(52) U.S. Cl.
CPC ..... *H05B 45/32* (2020.01)

(58) Field of Classification Search
CPC ..... H05B 45/20; H05B 45/30; H05B 45/32; H05B 45/44; H05B 33/08; H05B 33/083; H05B 33/042; H05B 33/089
See application file for complete search history.

(56) References Cited

U.S. PATENT DOCUMENTS

| | | | | |
|---|---|---|---|---|
| 8,994,278 | B2 * | 3/2015 | Grebner | H05B 45/48 315/186 |
| 9,271,345 | B2 * | 2/2016 | Welten | H05B 45/3575 |
| 10,039,159 | B1 * | 7/2018 | Xiong | H05B 45/37 |
| 10,039,164 | B1 * | 7/2018 | Peng | H05B 45/48 |
| 2011/0084619 | A1 * | 4/2011 | Gray | H05B 45/44 315/185 R |
| 2012/0081009 | A1 * | 4/2012 | Shteynberg | H05B 45/46 315/122 |

* cited by examiner

*Primary Examiner* — Thai Pham
(74) *Attorney, Agent, or Firm* — Chun-Ming Shih; HDLS IPR Services

(57) ABSTRACT

A method of sequencing an LED light string includes steps of: (a) using a control module to provide a pulse signal to an LED light string having a plurality of LED lights, (b) obtaining an LED light with a current sequence characteristic of the LED light string at a first rising edge or a first falling edge of the pulse signal, (c) self memorizing, by the LED light, as a current sequence, and changing a self state of the LED light so that the current sequence characteristic is no longer generated, and (d) repeating to perform step (b) and (c) at next rising edge or next falling edge of the pulse signal so as to obtain the sequence of the LED lights.

18 Claims, 11 Drawing Sheets

METHOD OF SEQUENCING LED LIGHT STRING, SELF-SEQUENCING LED LIGHT STRING SYSTEM, AND LED LIGHT

BACKGROUND

Technical Field

The present disclosure relates to a method of sequencing LED light string, self-sequencing LED light string system, and LED lights, and more particularly to a method of sequencing LED light string, self-sequencing LED light string system, and LED lights by suing a transient impedance to sort the sequence thereof.

Description of Related Art

The statements in this section merely provide background information related to the present disclosure and do not necessarily constitute prior art.

LED lights refer to lights that use light-emitting diodes (LEDs) as light sources, and are generally made of semiconductor LEDs. Since the life and luminous efficiency of LED lights can reach multiples of incandescent lamps and it is also much higher than integrated fluorescent lamps, more and more products on the market use LED lights to replace traditional fluorescent lamps. Since the LED light contains the controller, the LED lights are connected in series to form an LED light string, and the address of each LED is set by burning to make the LED lights in the LED light string have a sequential product. Therefore, it is becoming more and more popular in the market.

However, since the LED light address in the LED light string must be burned using special programming equipment, the manufacturer must sort the current sequence of the LEDs before the LED light string is shipped from the factory. The LED light string has a sequence function when it leaves the factory, otherwise the LED light string cannot be controlled in an ordered manner. Therefore, manufacturers will have to carry out the tedious process of ordering and sequentially burning LED lights before leaving the factory, which causes inconvenience and time-consuming work in product manufacturing. Since the address of the LED light is pre-programmed before leaving the factory, after the LED light string leaves the factory, if there is a failure of the LED light in the light string, the user cannot perform the LED by the user replacing the LED light by himself to maintain the LED light string. Therefore, if the LED light is damaged, only the entire group of the LED light string can be scrapped, or the entire group of the LED light string must be returned to the original factory for repair, thereby causing inconvenience in use.

Therefore, how to design a method of sequencing LED light strings, a self-sequencing LED light string system, and LED lights, using a simple impedance principle so that the LED light strings do not need to be pre-programmed address before leaving the factory. Also, when the LED light is damaged, the user can replace the LED light by himself, which is a major problem that the inventor wants to overcome and solve.

SUMMARY

In order to solve the above-mentioned problems, a method of sequencing an LED light string is provided, and the method includes the following steps of: (a) using a control module to provide a pulse signal to an LED light string having a plurality of LED lights, (b) obtaining an LED light with a current sequence characteristic of the LED light string at a first rising edge or a first falling edge of the pulse signal, (c) self-memorizing, by the LED light, as a current sequence, and changing a self state of the LED light so that the current sequence characteristic is no longer generated, and (d) repeating to perform step (b) and (c) at next rising edge or next falling edge of the pulse signal so as to obtain the sequence of the LED lights.

In order to solve the above-mentioned problems, a self-sequencing LED light is provided, and the self-sequencing LED light includes a controller, a light-emitting component, and a status adjustment unit. The controller has an input end and an output end, and the input end receives a pulse signal. The light-emitting component is coupled to the controller. The status adjustment unit is coupled in parallel to the controller. When the LED light in a sequence mode and the controller obtains a current sequence characteristic at the rising edge or the falling edge of the pulse signal, the controller self memorizes as a current sequence and provide a status adjustment signal to the status adjustment unit to change a self state of the controller; when the LED light is in a working mode, the controller controls the light-emitting component to emit light according to the pulse signal.

In order to solve the above-mentioned problems, a self-sequencing LED light string system is provided, and the self-sequencing LED light string system includes a control unit, a switching switch, and an LED light string. The control unit is coupled to an input power source. The switching switch is coupled to the control unit. The LED light string is coupled to the switching switch, and includes a plurality of LED lights in series. The control unit controls the switching switch to switch the input power source to a pulse signal, and the LED light string performs self-sequencing of the LED lights according to the pulse signal; or the LED lights are controlled to emit light according to the pulse signal.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWINGS

The present disclosure can be more fully understood by reading the following detailed description of the embodiment, with reference made to the accompanying drawing as follows.

DETAILED DESCRIPTION

Figure 1:
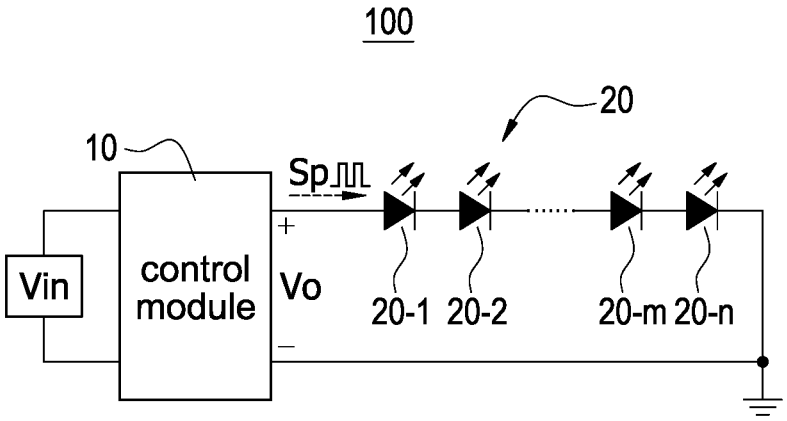
FIG. 1 is a block diagram of an LED light string system according to the present disclosure.

Reference will now be made to the drawing figures to describe the present disclosure in detail. It will be understood that the drawing figures and exemplified embodiments of present disclosure are not limited to the details thereof.

In the present disclosure, "component A is coupled to component B" except for the case where component A and component B are electrically directly connected (that is, power is directly transmitted from component A to component B without passing through other components). Also, it includes the following cases: as long as it does not substantially affect the electrical connection state of component A and component B or damage the function or effect achieved by their coupling, component A and component B can pass through other components indirect connection. That is, one or more other components may be disposed between the component A and the component B, and power is transferred from the component A to the component B through the one or more other components.

Similarly, electrical connections that are "between" or "across" other features may not be directly connected to each of their other features. For example, "the state where the component C is coupled between the component A and the component B" includes the case where the component A and component C or the component B and the component C are directly and electrically connected, as well as the following situations: the electrical connection state of the electronic device can cause a substantial impact or does not destroy the function or effect achieved by their coupling, and can be electrically connected indirectly through other components.

In addition, if you describe the transmission and provision of telecommunication signals, those skilled in this art should be able to understand that the transmission of telecommunications signals may be accompanied by attenuation or other non-ideal changes. Unless otherwise specified, the source and receiver of a telecommunications signal transmission shall be regarded as essentially the same signal. For example, if the electrical signal S (for example, a control signal, etc.) is transmitted (or provided) from a contact A of the electronic circuit to a contact B of the electronic circuit, it may pass through both ends of the source and drain of a transistor switch and/or possible stray capacitance and voltage drop, but the purpose of this design is not to use the attenuation or other non-ideal changes in transmission (or supply) to achieve certain specific technical effects, the electrical signal S in the contact A and the contact B of the electronic circuit shall be regarded as substantially the same signal.

Please refer to FIG. 1, which shows a block diagram of an LED light string system according to the present disclosure. The LED light string system 100 includes a control module 10 and an LED light string 20. The control module 10 receives an input power source Vin and converts the input power source Vin into a pulse signal Sp to the LED light string 20. The LED light string 20 includes a plurality of LED lights 20-1 to **20-*n*, and the LED lights 20-1 to 20-*n* are coupled in series. In particular, the pulse signal Sp is a signal that switches between a high level and a low level, and for example but not limited to that the high level is 30 volts and the low level is 20 volts. The LED light string 20 can correspondingly control the LED lights 20-1 to 20-*n* through switching high-level signal and low-level signal. In one embodiment, the high-level voltage of the pulse signal Sp is a voltage that can supply the required voltage to the LED light string 20 for stable operation. Therefore, the control module 10 is coupled to the LED light string 20 through a single path to supply power to the LED light string 20 and control the LED lights 20-1 to 20-*n*. In addition, in one embodiment, the input power source Vin received by the control module 10 is a DC voltage. If the LED light string system 100 is coupled to an AC main power, an AC-to-DC converter (not shown) may be installed at the front end of the control module 10** to convert the AC main power into the DC input power source Vin.

Figure 2A:
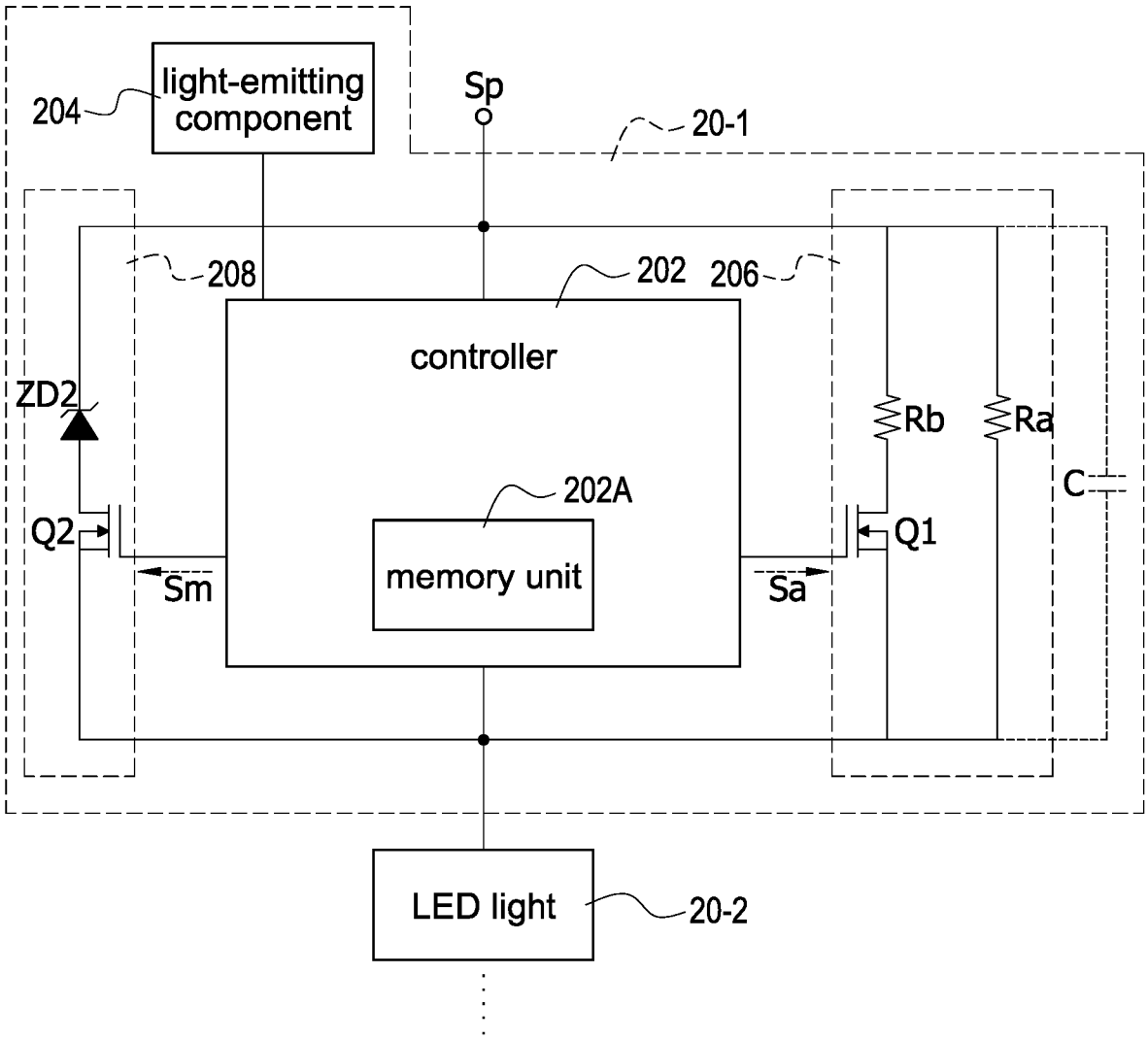
FIG. 2A is a block circuit diagram of an LED light according to a first embodiment of the present disclosure.

Please refer to FIG. 2A, which shows a block circuit diagram of an LED light according to a first embodiment of the present disclosure, and also refer to FIG. 1. Each of the LED lights 20-1 to **20-*n* includes a controller 202, and the controller 202 has an input end and an output end. The LED lights 20-1 to 20-*n* are coupled in series by connecting the input end to the output end, and the input end receives the pulse signal Sp. In particular, the pulse signal Sp may include signals of controlling the lighting of the LED lights 20-1 to 20-*n*, controlling the color of the LED lights 20-1 to 20-*n*, controlling the light emitting change mode of the LED lights 20-1 to 20-*n*, and sequencing and resetting LED lights 20-1 to 20-*n***.

Specifically, before the conventional LED light string 20 leaves the factory, the controller 202 of each LED light 20-1 to **20-*n* must burn the address to arrange the sequence of the LED lights 20-1 to 20-*n*, otherwise the control module 10 cannot control the LED light string 20 in an ordered manner. Moreover, after the LED light string 20 is shipped from the factory, since the sequence of the LED lights 20-1 to 20-*n* has been determined by the programming address, if one of the LED lights 20-1 to 20-*n* in the LED light string 20 is damaged, the user cannot replace the LED light 20-1 to 20-*n* by himself to repair the LED light string 20 since it is impossible to know in advance which number of the damaged LED light 20-1 to 20-*n*. The feature of the present disclosure is that before the LED light string 20 is controlled in an ordered manner (that is, before the LED light string system 100 officially operates), the control module 10 first performs the sequence of the LED light string 20 to make the sequence of the LED lights 20-1 to 20-*n* can be self-arranged after the LED light string 20 leaves the factory. Therefore, before the LED light string 20 is shipped from the factory, the controller 202 does not need to be programmed to address the sequence of the LED lights 20-1 to 20-*n*. Therefore, it can achieve the effects of significantly reducing the manufacturing time, the time for installing in order, and increasing the convenience of manufacturing. Moreover, after the LED light string 20 is shipped from the factory, and when one of the LED lights 20-1 to 20-*n* in the LED light string 20 is damaged, the user can replace the LED lights 20-1 to 20-*n* by himself to maintain the LED light string 20 (i.e., re-sequencing by using the control module 10**). Therefore, the effect of significantly increasing convenience and flexibility can be achieved.

Refer to FIG. 2A again, each of the LED lights 20-1 to **20-*n* includes a light-emitting component 204, a status adjustment unit 206, and a mode control unit 208. The light-emitting component 204 is coupled to the controller 202, and the light-emitting component 204 includes a plurality of LEDs with different colors. The controller 202 controls the lighting, the light-emitting color, and the light-emitting changing manner of the light-emitting component 204 through the pulse signal Sp. The status adjustment unit 206 is coupled in parallel to the controller 202 (i.e., is coupled to the input end and output end of the controller 202) to make the status adjustment to the controller 202. The mode control unit 208 is coupled in parallel to the controller 202, and the controller 202 sets itself as a sequence mode or a working mode through the mode control unit 208. In the sequence mode, the controller 202 determines whether the controller 202 itself is the current sequence; in the working mode, the controller 202 makes the light control to the light-emitting component 204** according to the pulse signal Sp.

The status adjustment unit 206 includes a first impedance component Ra, a second impedance component Rb, and a first switch Q1. The first impedance component Ra is coupled in parallel to the controller 202, the second impedance component Rb is coupled in series to the first switch Q1, and the second impedance component Rb and the first switch Q1 are coupled in parallel to the first impedance component Ra. The controller 202 controls turning on or turning off the first switch Q1 so as to control whether the first impedance component Ra is coupled in parallel to the second impedance component Rb. When the controller 202 does not provide a status adjustment signal Sa to the first switch Q1, the first switch Q1 is turned off so that the first impedance component Ra is coupled in parallel to the controller 202. At this condition, the equivalent impedance of the controller 202 is a first impedance. When the controller 202 provides the status adjustment signal Sa to the first switch Q1, the first switch Q1 is turned on so that the first impedance component Ra is coupled in parallel to the second impedance component Rb and the controller 202. At this condition, the equivalent impedance of the controller 202 is a second impedance. Since the impedance of the first impedance component Ra is larger that of the second impedance component Rb, the first impedance of the controller 202 is larger than the second impedance thereof. The above is the first way for the controller 202 to change its own state, which uses the parallel connection of the first impedance component Ra and the second impedance component Rb to change the state of the controller 202 itself. The second way for the controller 202 to change its state will be further described in FIG. 2B.

The mode control unit 208 includes a second voltage-stabilizing unit ZD2 and a second switch Q2. The second voltage-stabilizing unit ZD2 is coupled in series to the second switch Q2, and the second voltage-stabilizing unit ZD2 is coupled in parallel to the controller 202. The controller 202 controls turning on or turning off to set self in a sequence mode or a working mode. When the controller 202 does not provide a mode control signal Sm to the second switch Q2, the second switch Q2 is turned off so that the second voltage-stabilizing unit ZD2 is not coupled in parallel to the controller 202. At this condition, the controller 202 enters the sequence mode, and the voltage value at the input end and the output end of the controller 202 will be affected by the instantaneous switching of the level of the pulse signal Sp to generate a relatively obvious surge voltage. When the controller 202 provides the mode control signal Sm to the second switch Q2, the second switch Q2 is turned on so that the second voltage-stabilizing unit ZD2 is coupled in parallel to the controller 202. At this condition, the controller 202 enters the working mode, and the second voltage-stabilizing unit ZD2 clamps the voltage value between the input end and the output end of the controller 202 to the second voltage stabilizing voltage so that the instantaneous switching of the level of the pulse signal Sp is less likely to make the two ends of the controller 202 more obvious surge voltage.

Specifically, when the LED lights 20-1 to **20-*n* are in the sequence mode, the controller 202 sets itself as the sequence mode through the mode control unit 208. In the sequence mode, the controllers 202 of the LED lights 20-1 to 20-*n* obtain the current sequence characteristic at the rising edge or the falling edge of the pulse signal Sp. The controller 202, which has obtained the current sequence characteristics, memorizes itself as the current sequence, and provides a status adjustment signal Sa to the status adjustment unit 206 so that the controllers 202 of the LED lights 20-1 to 20-*n* change its state. When the sequencing of the LED lights 20-1 to 20-*n* is completed, the controller 202 sets itself as the working mode through the mode control unit 208. Afterward, in the working mode, the controller 202 controls the light-emitting component 204** lighting according to the pulse signal Sp.

Figure 2B:
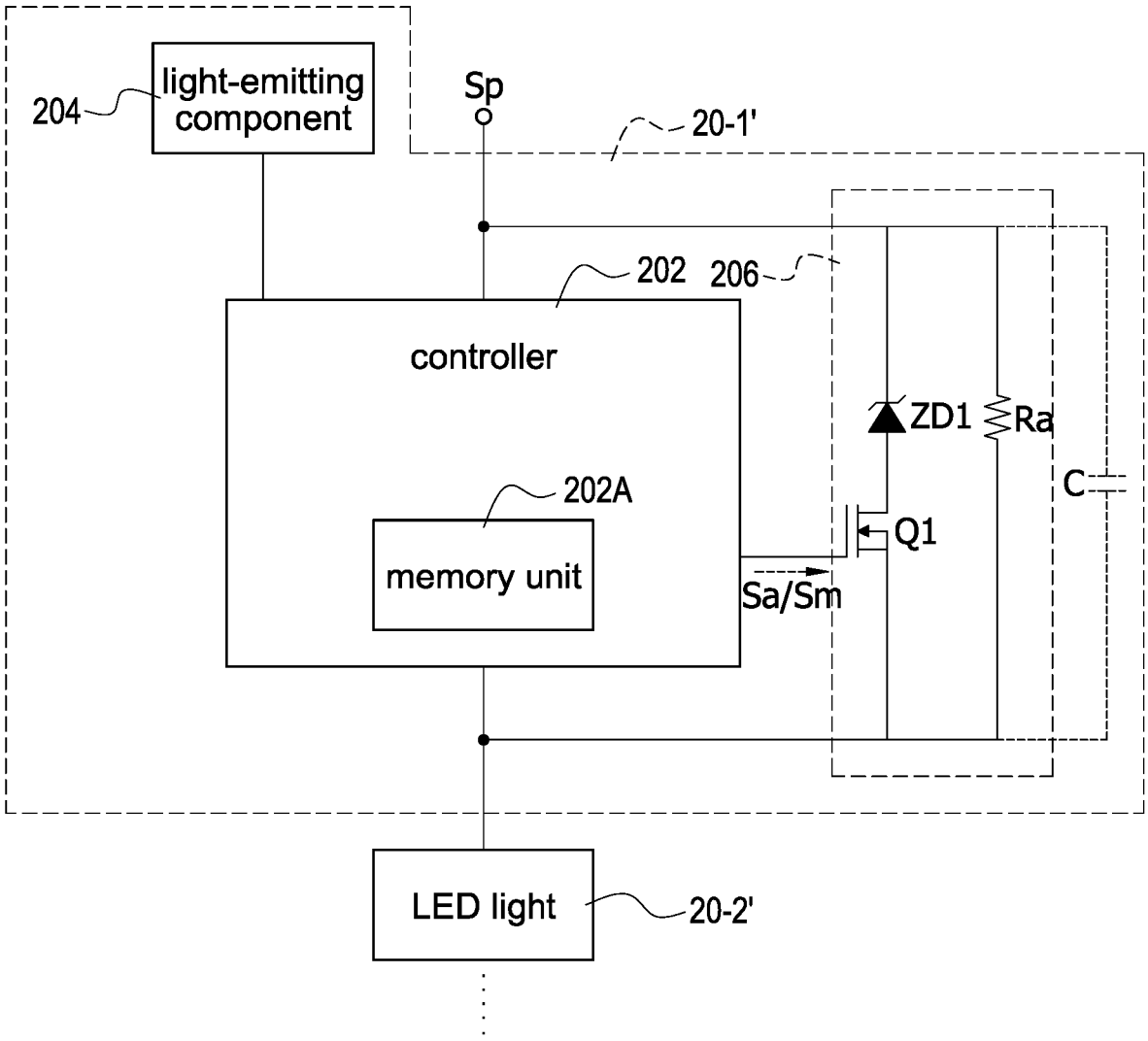
FIG. 2B is a block circuit diagram of the LED light according to a second embodiment of the present disclosure.

Please refer to FIG. 2B, which shows a block circuit diagram of the LED light according to a second embodiment of the present disclosure, and also refer to FIG. 1 to FIG. 2A. The major difference between the LED lights 20-1' to **20-*n*' shown in FIG. 2B and the LED lights 20-1 to 20-*n* shown in FIG. 2A is that the function of the status adjustment unit 206 of FIG. 2A is integrated with the function of the mode control unit 208, and the LED lights 20-1' to 20-*n*' in the embodiment of FIG. 2B may not include the mode control unit 208 of FIG. 2A. The status adjustment unit 206' includes a first impedance component Ra, a first voltage-stabilizing unit ZD1, and a first switch Q1. The first impedance component Ra is coupled in parallel to the controller 202, the first voltage-stabilizing unit ZD1 is coupled in series to the first switch Q1, and the first voltage-stabilizing unit ZD1 and the first switch Q1** are coupled in parallel to the first impedance component Ra.

When the sequence mode starts, the first switches Q1 inside the LED lights 20-1' to **20-*n*' are not turned on, however, the first switches Q1 inside the LED lights 20-1' to 20-*n*' are turned on one by one during the sequencing process. Specifically, in the sequence mode, the controller 2020 provides the status adjustment signal Sa to control turning on or turning off the first switch Q1 so as to control whether the first impedance component Ra is coupled in parallel to the first voltage-stabilizing unit ZD1. When the controller 202 does not provide the status adjustment signal Sa to the first switch Q1, the first switch Q1 is turned off so that the first impedance component Ra is coupled in parallel to the controller 202. At this condition, the equivalent impedance of the controller 202 is a first impedance. When the controller 202 provides the status adjustment signal Sa to the first switch Q1, the first switch Q1 is turned on so that the first impedance component Ra is coupled in parallel to the first voltage-stabilizing unit ZD1 and the controller 202. At this condition, when the controller 202 is at the rising edge of the pulse signal Sp, the first voltage-stabilizing unit ZD1 clamps the voltage value across the input end and the output end of the controller 202** to the first stabilization voltage.

When the sequence of the LED lights 20-1' to **20-*n*' is completed, the controllers 202 inside the LED lights 20-1' to 20-*n*' provide a mode control signal Sm to turn on the first switch Q1 (i.e., the first switches Q1 in the LED lights 20-1' to 20-*n*' are all turned on). Therefore, the first voltage-stabilizing unit ZD1 clamps the voltage value across the input end and the output end of the controller 202 to the first stabilization voltage to set itself as the working mode. In the working mode, the controller 202 controls the light-emitting component 204 to emit light according to the pulse signal Sp. In FIG. 2B, the status adjustment signal Sa and the mode control signal Sm are both control signals that turn on or turn off the first switch Q1. The difference is only that the status adjustment signal Sa is a control signal in the sequence mode and the mode control signal Sm is a control signal in the working mode. Therefore, the voltage levels of the control signals that the two switches turn on the first switch Q1 can be the same or different voltage levels. The specific operation modes of the internal circuits of the status adjustment unit 206 and the mode control unit 208** will be further described later.

Figure 3:
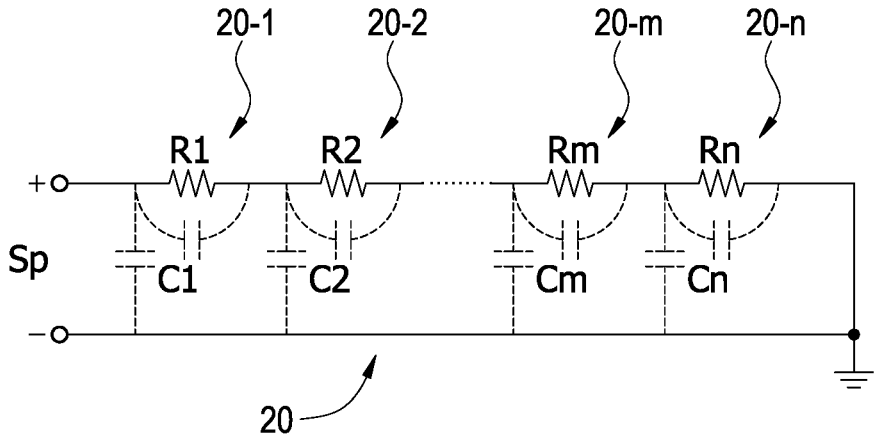
FIG. 3 is an equivalent circuit diagram of an LED light string according to the present disclosure.

Please refer to FIG. 3, which shows an equivalent circuit diagram of an LED light string according to the present disclosure, and also refer to FIG. 1 to FIG. 2B. Each LED light 20-1 to **20-*n* can be equivalent to resistors R1 to Rn. When the voltage across the LED light 20-1 to 20-*n* changes instantly, the difference in voltage value will make each LED light 20-1 to 20-*n* produces equivalent parasitic capacitances C1 to Cn. Therefore, the sequence of LED lights 20-1 to 20-*n* can be obtained by using the impedance distribution (series structure) of the LED light strings 20 and the parasitic capacitances C1 to Cn when the voltage across the LED lights 20-1 to 20-*n* is instantaneously changed. Since the equivalent circuit structure of this light string will change the voltage across the LED light 20-1 to 20-*n* at the moment, it will cause the parasitic capacitances C1 to Cn to produce the difference in the charging voltage and the charging time, and therefore two methods of sequencing LED light strings 20 can be proposed. Also refer to FIG. 2, since the parasitic capacitances C1 to Cn are equivalent parasitic components, the parasitic effect makes the transient response obtained by the LED lights 20-1 to 20-*n* relatively unstable, it is easy to cause the transient voltage of the LED lights 20-1 to 20-*n* to fluctuate due to the change of the capacitance value, resulting in incorrect sequence. Therefore, a physical capacitor C (indicated by dotted lines) can also be connected in parallel at both ends of the internal controller 202 of each LED light 20-1 to 20-*n* so that the transient response of the LED lights 20-1 to 20-*n* during sequencing is stable and obvious so as to improve the stability of the LED light string 20** during sequencing.

In addition, in one embodiment of the present disclosure, the physical capacitor C shown in FIG. 2 may be disposed inside the controller 202 or disposed outside the controller 202. Specifically, the controller 202, the status adjustment unit 206, and the mode control unit 208 can be combined into an independent integrated circuit (IC), and the physical capacitor C can be an independent component (same as the light-emitting component 204). Alternatively, the controller 202, the status adjustment unit 206, the mode control unit 208, and the physical capacitor C can be combined into an independent integrated circuit (IC).

Please refer to FIG. 1 to FIG. 3, the method of sequencing the LED light string 20 of the present disclosure is to perform the sequence mode of the LED light string before the LED light string 20 is not sequenced, and then perform the working mode after the sequencing is completed. There are at least three determination manners of switching between modes. The first determination manner is: switching between modes can be controlled by the controller 202 receiving the pulse signal Sp provided by the control module 10. Specifically, when preparing to enter the sequence mode, the control module 10 provides the pulse signal Sp to start the sequencing to inform the controller 202 inside the LED lights 20-1 to **20-*n* so that the controller 202 knows to enter the sequence mode. Afterward, after the sequencing is completed, the control module 10 provides the pulse signal Sp that ends the sequencing to inform the LED lights 20-1 to 20-*n* that the sequencing is completed so that the controller 202 knows that it has entered the working mode. The second determination manner is: switching between modes can be counted and determined by the controller 202. Specifically, in the sequence mode, since the number of rising edges or falling edges of the pulse signal Sp provided by the control module 10 is equal to the number of the LED lights 20-1 to 20-*n*, the controller 202 can count and determine whether the number of rising edges or the number of falling edges is equal to the number of LED lights 20-1 to 20-*n*. When the number of rising edges or the number of falling edges is not equal to the number of LED lights 20-1 to 20-*n*, the sequential sequence mode is continued. When the number of rising edges or the number of falling edges is equal to the number of the LED lights 20-1 to 20-*n*, the controller 202 knows itself and switches to the working mode. The third determination manner is: switching between modes can be determined by the controller 202** by itself and the timing manner is similar to the counting manner described above. The difference is in the time at which the obtained sequence is completed at the pulse signal Sp, which will not be repeated here.

The method of sequencing the LED light string 20 of the present disclosure uses the transient features generated at the ends of the internal controller 202 of each LED light 20-1 to **20-*n* to perform the sequence of the LED light string 20 by the rising edge or the falling edge of the pulse signal. It can be known from FIG. 3 that the equivalent impedance of each LED light 20-1 to 20-*n* is different due to the parasitic capacitances C1 to Cn (or physical capacitance), resulting in different transient features at the rising or falling edge of the pulse signal Sp. When the rising edge or falling edge of the pulse signal Sp, both ends of each controller 202 will have transient features. Due to the relationship between the rising edge or falling edge charging the parasitic capacitances C1 to Cn (or physical capacitors), its transient features can be the transient voltage, the charging time to charge to the first predetermined voltage, or the discharging time to discharge to the second predetermined voltage. When the transient features of one of the LED lights 20-1 to 20-*n* in the LED light string 20 conform to the current sequence characteristic (for example but not limited to, the LED light 20-1 conforms to the current sequence characteristic), LED light 20-1 is the current sequence of LED lights, and self memorized as the current sequence. For example, but not limited to, the current sequence is 1, and the LED light 20-1 memorizes the address of the number 1**, and so on.

Figure 4:
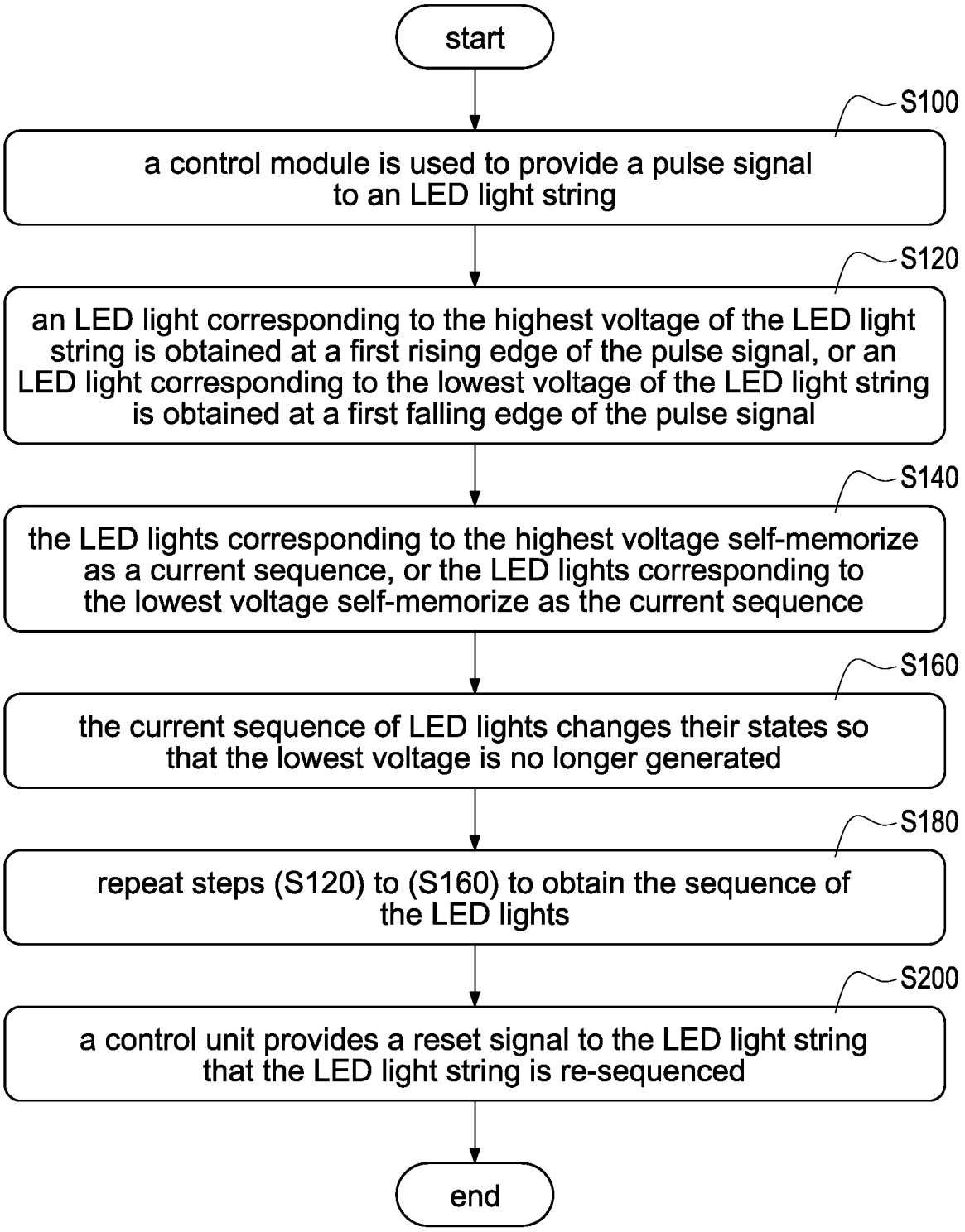
FIG. 4 is a flowchart of a method of sequencing an LED light string according to a first embodiment of the present disclosure.

Please refer to FIG. 4, which shows a flowchart of a method of sequencing an LED light string according to a first embodiment of the present disclosure, and also refer to FIG. 1 to FIG. 3. In this embodiment, the difference in the charging voltage generated by the parasitic capacitances C1 to Cn is used to sequence the LED light string 20, which means that the current sequence characteristic is defined as the highest voltage or the lowest voltage. Specifically, when the surge voltage generated by the LED lights 20-1 to **20-*n* at the rising edge of the pulse signal Sp is higher than the surge voltage of the remaining LED lights 20-1 to 20-*n*, the surge voltage of the LED light is defined as the highest Voltage. Alternatively, when the surge voltage generated by the LED lights 20-1 to 20-*n* at the falling edge of the pulse signal Sp is lower than the surge voltage of the remaining LED lights 20-1 to 20-*n*, the surge voltage of the LED light is defined as the lowest voltage. The method includes the following steps. First, the control module is used to provide the pulse signal to an LED light string (S100). When entering the sequence mode, the controller 202 can use the three determination manners described above to know to enter the sequence mode. At this condition, the controller 202 controls the second switch Q2 to be turned off so that the LED lights 20-1 to 20-*n* enter a sequence mode, and the control module 10 provides a pulse signal Sp to the LED light string 20 to start the sequence process. Afterward, an LED light corresponding to the highest voltage of the LED light string is obtained at the first rising edge of the pulse signal, or an LED light corresponding to the lowest voltage of the LED light string is obtained at the first falling edge of the pulse signal (S120**). The current sequence characteristic of this embodiment uses the highest voltage or the lowest voltage.

Take the circuit in FIG. 2A at the rising edge as an example. Before the LED lights 20-1 to **20-*n* have been sequenced, the equivalent impedance of the LED lights 20-1 to 20-*n* is the first impedance (i.e., a high impedance). Therefore, from the impedance distribution and parasitic capacitances C1 to Cn in FIG. 3, it can be known that when the rising edge or the falling edge of the pulse signal Sp is provided to the LED light string 20, the transient equivalent impedance of each LED light 20-1 to 20-*n* is different so that two ends of each LED light 20-1 to 20-*n* will have different surge voltages (transient features) according to the rising edge or the falling edge of the pulse signal Sp. At the rising edge, the higher the surge voltage, the higher the transient voltage spike caused by the transient equivalent impedance of the LED lights 20-1 to 20-*n*, which means that the sequence of the LED lights 20-1 to 20-*n* is more advanced. Therefore, each LED light 20-1 to 20-*n* detects the self-generated surge voltage at the rising edge of the pulse signal Sp. Since the impedance and parasitic capacitance of the LED lights 20-1 to 20-*n* are different, the closer to the LED lights 20-1 to 20-*n* to the control module 10, the higher the surge voltage. The same threshold voltage will be set inside each LED light 20-1 to 20-*n*. At the same rising edge, only the surge voltage is the highest voltage will be greater than this threshold voltage. That is, at the same rising edge, only the surge voltage of the LED lights 20-1 to 20-*n* closest to the control module 10** will be greater than this threshold voltage, and this surge voltage is the highest voltage (current sequence characteristic).

Figure 5A:
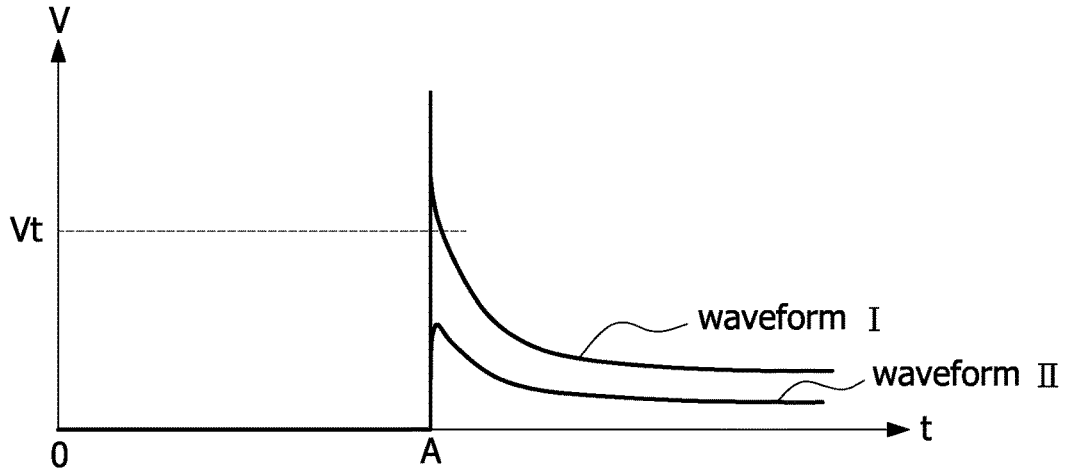
FIG. 5A is a schematic waveform of a surge voltage at a rising edge of a pulse signal according to a first embodiment of the present disclosure.
Figure 5B:
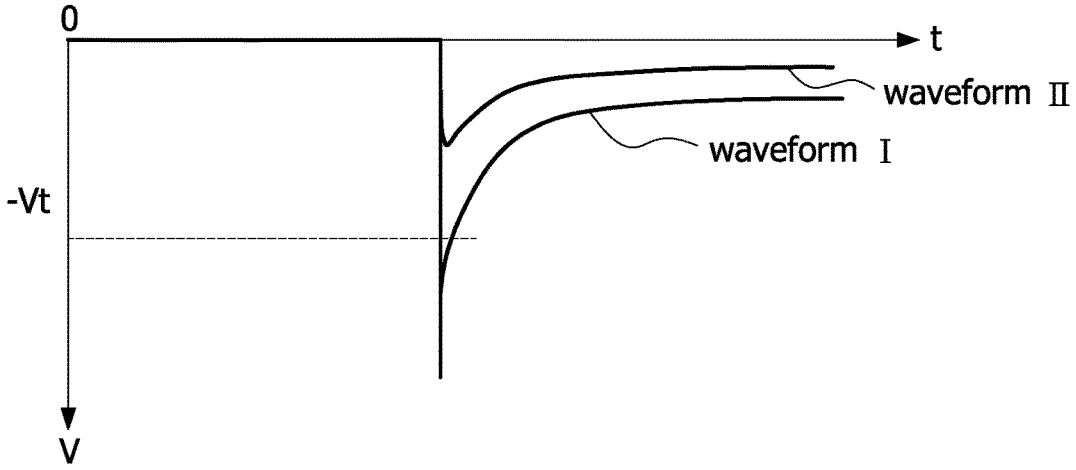
FIG. 5B is a schematic waveform of a surge voltage at a falling edge of the pulse signal according to a first embodiment of the present disclosure.

Afterward, the LED lights corresponding to the highest voltage self-memorize as the current sequence, or the LED lights corresponding to the lowest voltage self-memorize as the current sequence (S140). Taking the rising edge of the circuit in FIG. 2A as an example, since each LED light 20-1 to **20-*n* will set the same threshold voltage, and at the same rising edge, only the surge voltage of the LED lights 20-1 to 20-*n* closest to the control module 10 will be greater than this threshold voltage. Therefore, when the LED lights 20-1 to 20-*n* detect that their surge voltage is greater than the threshold voltage (i.e., the highest voltage), they record themselves as the current sequence. In particular, the current sequence refers to the LED lights 20-1 to 20-*n* using the pulse number as their sequence. For example, the first pulse is in first sequence, the second pulse is in second sequence, and so on. Please refer to FIG. 5A, which shows a schematic waveform of a surge voltage at a rising edge of a pulse signal according to a first embodiment of the present disclosure, and also refer to FIG. 2A. The LED light 20-1 to 20-*n* corresponding to the highest voltage (waveform I) obtained by the first rising edge is sorted as the first number (that is, the sequence is 1). In particular, the threshold voltage Vt is a threshold set in the controller 202. When the LED lights 20-1 to 20-*n* generate the highest voltage, the highest voltage will exceed the threshold voltage Vt as shown in FIG. 5. The second highest voltage (waveform II) is only a comparison voltage value in this detection, which is not included in the sorting. Please refer to FIG. 5B, which shows a schematic waveform of a surge voltage at a falling edge of the pulse signal according to a first embodiment of the present disclosure, and also refer to FIG. 2A. FIG. 5B is exactly the opposite of FIG. 5A, and the minimum voltage needs to be lower than the threshold voltage −Vt. The rest is the same as FIG. 5A and will not be repeated here. Alternatively, the current sequence of LED lights changes their states so that the lowest voltage is no longer generated (S160). Taking the rising edge of the circuit in FIG. 2A as an example, since the LED lights 20-1 to 20-*n* in the current sequence have sorted by self-memorized, the LED lights 20-1 to 20-*n* in the current sequence change their impedance from the first impedance to the second impedance (i.e., from the high impedance to the low impedance). After the impedance of the LED lights 20-1 to 20-*n* in the current sequence is changed to the second impedance and when the second impedance causes the rising edge of the pulse signal Sp to be provided to the LED lights 20-1 to 20-*n* in the current sequence, the surge voltage generated by the ends of the LED lights 20-1 to 20-*n* in the current sequence is small (the surge voltage of the LED lights 20-1 to 20-*n* smaller than the current sequence is the first impedance). Therefore, the LED lights 20-1 to 20-*n* in the current sequence will not generate the highest voltage after being sorted so that the already sequenced LED lights 20-1 to 20-*n*** will not be reordered by mistake.

Further, refer to FIG. 2A again. The change of the states of the LED lights 20-1 to **20-*n* can be completed by the first impedance component Ra, the second impedance component Rb, and the first switch Q1. In particular, the resistance value of the first impedance component Ra is larger than that of the second impedance component Rb. When the LED lights 20-1 to 20-*n* have not been sequenced, the first switch Q1 is not turned on so that the equivalence of the LED lights 20-1 to 20-*n* is resistors R1 to Rn that can be regarded as the first impedance component Ra (i.e., the first impedance). When the LED lights 20-1 to 20-*n* have been sequenced, the first switch Q1 is turned on so that the first impedance component Ra is coupled in parallel to the second impedance component Rb. At this condition, the equivalence of the LED lights 20-1 to 20-*n* is resistors R1** to Rn that must be smaller than the second impedance component Rb (i.e., the second impedance). In one embodiment, the first impedance component Ra and the second impedance component Rb are resistors, but not limited thereto. Specifically, the reason why the first impedance component Ra and the second impedance component Rb use the resistors is that the resistance calculation of the resistor is easy and the price is relatively cheap. However, if the above factors are excluded, the first impedance component Ra and the second impedance component Rb may also be replaced by capacitive or inductive impedance components.

Afterward, repeat the steps (S120) to (S160) to obtain the sequence of the LED lights (S180). Taking the rising edge of the circuit in FIG. 2A as an example, the LED lights 20-1 to 20-*n* obtain the highest voltage in sequence through each rising edge of the pulse signal Sp, and the numbers of the LED lights 20-1 to 20-*n* are sequenced one by one. At the end of the series of rising edges of the pulse signal Sp, a complete sequence of the LED lights 20-1 to 20-*n* is obtained. Since the LED lights 20-1 to 20-*n* are coupled in series (as the impedance distribution shown in FIG. 3), the last LED light 20-*n* of the LED light string 20 has not changed from the first impedance to the second impedance, and the value of the first impedance must be greater than the sum of the second impedance of each of the remaining LED lights 20-1 to 20-*m*, thereby avoiding the summed second impedance value being too large and causing the last LED light 20-*n* misjudgment to cause incorrect sequence of LED lights 20-1 to 20-*n*. When the LED lights 20-1 to 20-*n* are completed, the controller 202 will change the mode to the working mode. At this condition, the controller 202 turns on the second switch Q2 so that the second voltage-stabilizing unit ZD2 is coupled in parallel with the controller 202 so as to stabilize the voltage value across the input end and output end of the controller 202 at the second stabilized voltage. In one embodiment, the above-mentioned steps (S120) to (S180) happen to be opposite in the falling edge of the pulse signal Sp, and will not be described again here.

Finally, the control unit provides a reset signal to the LED light string so that the LED light string is re-sequenced (S200). The control module 10 may perform a procedure for resequencing the LED light string 20, such as but not limited to, replacement of the LED lights 20-1 to 20-*n*. Specifically, when the software (such as the error of the control module 10) or the hardware (such as the LED lights 20-1 to 20-*n* are replaced and the sequence is wrong) can unexpectedly affect the sequence of the LED light string 20, the LED light string 20 would abnormally operate. At this condition, the control module 10 can reset the LED light string 20 to an initial state by providing a reset signal to the LED light string 20. Afterward, the control module 10 provides a pulse signal Sp so that the LED light string 20 can be re-sequenced.

Figure 5C:
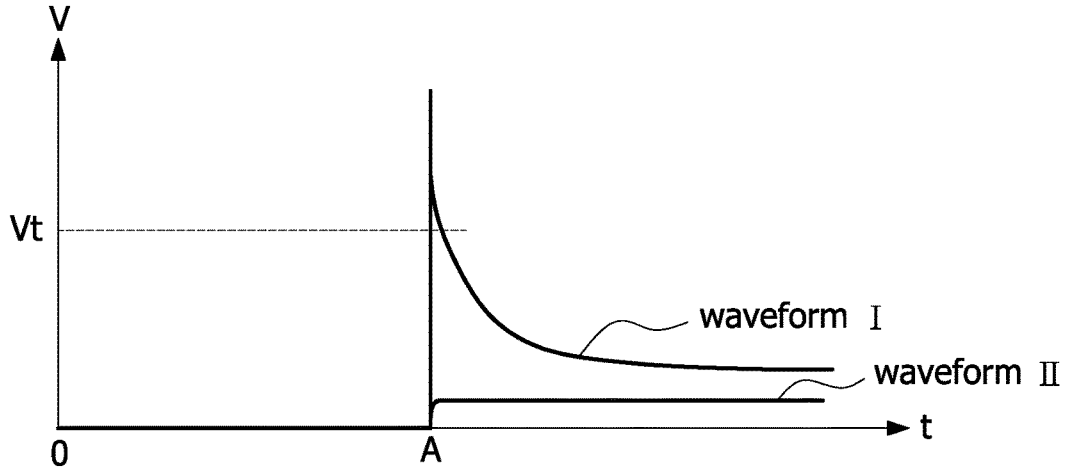
FIG. 5C is a schematic waveform of a surge voltage at the rising edge of the pulse signal according to a second embodiment of the present disclosure.

Please refer to FIG. 5C, which shows a schematic waveform of a surge voltage at the rising edge of the pulse signal according to a second embodiment of the present disclosure, and also refer to FIG. 2B. In FIG. 5C, it is assumed that the sequence of the first LED light 20-1' has been completed. The LED light 20-2' corresponding to the highest voltage (waveform I) obtained by the second rising edge is sorted into the second number (i.e., the sequence is 2). Since the sequence of the first LED light 20-1' is completed and the first switch Q1 is turned on, at the second rising edge, the first voltage stabilization unit ZD1 of the first LED light 20-1' with the first sequence would clamp the LED light 20-1' to the first stabilization voltage (waveform II). In FIG. 5C, it can be clearly seen that the difference between the waveform II of the LED light 20-1' in the first sequence and the waveform I of the LED light 20-2' in the current sequence, and the difference may allow the controller 202 to explicitly know whether the self is in the current sequence.

Figure 6:
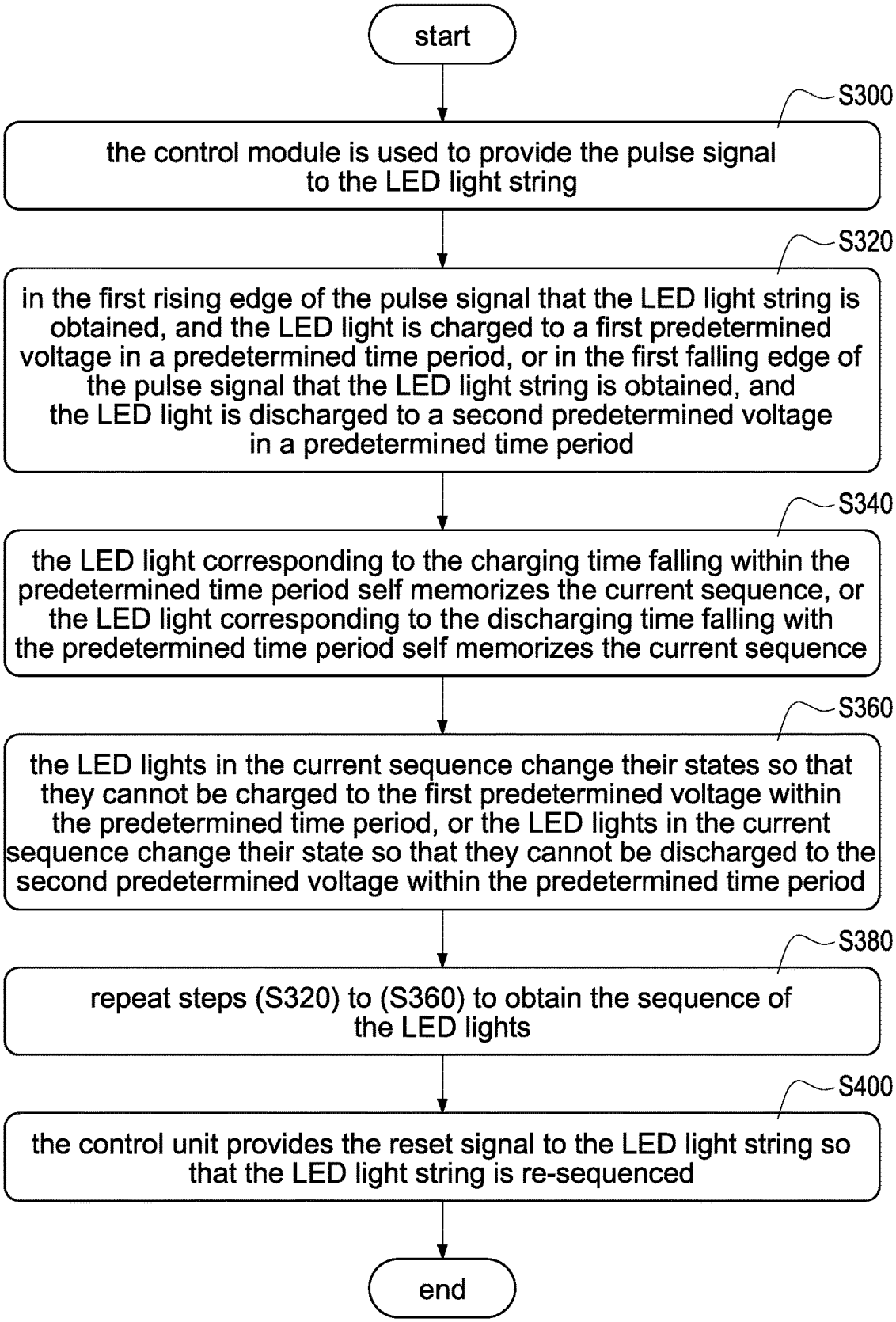
FIG. 6 is a flowchart of a method of sequencing the LED light string according to a second embodiment of the present disclosure.

Please refer to FIG. 6, which shows a flowchart of a method of sequencing the LED light string according to a second embodiment of the present disclosure, and also refer to FIG. 1 to FIG. 5. The difference between this embodiment shown in FIG. 6 and the first embodiment shown in FIG. 4 is that the difference in charging time generated by the parasitic capacitances C1 to Cn is used to sequence the LED light strings, which means that the current sequence characteristic is defined as a predetermined time period in this embodiment. Specifically, when the charging time of the LED lights 20-1 to 20-*n* to the first predetermined voltage at the rising edge of the pulse signal Sp is faster than the charging time of the remaining LED lights 20-1 to 20-*n*, the charging time of the LED lights 20-1 to 20-*n* falls within a predetermined time period in this embodiment. Alternatively, when the discharging time of the LED lights 20-1 to 20-*n* to the second predetermined voltage at the falling edge of the pulse signal Sp is faster than the discharging time of the remaining LED lights 20-1 to 20-*n*, the discharging time of the LED lights 20-1 to 20-*n* falls within the predetermined time period in this embodiment. In particular, step (S300) is the same as step (S100), step (S380) is the same as step (S180), and step (S200) is the same as step (S400). The difference is that in the first rising edge of the pulse signal that the LED light string is obtained, and the LED light is charged to a first predetermined voltage in a predetermined time period, or in the first falling edge of the pulse signal that the LED light string is obtained, and the LED light is discharged to a second predetermined voltage in a predetermined time period (S320). In particular, the current sequence characteristic of this embodiment uses a predetermined time period. Take the circuit in FIG. 2A at the rising edge as an example, before the LED lights 20-1 to 20-*n* have been sequenced, the equivalent impedance of the LED lights 20-1 to 20-*n* is the first impedance (i.e., the high impedance). Therefore, it can be known from the impedance distribution and parasitic capacitances C1 to Cn in FIG. 3 that when the rising edge of the pulse signal Sp is instantaneously provided to the LED light string, the transient equivalent impedance of each LED light 20-1 to 20-*n* is different so that the charging time of each LED light 20-1 to 20-*n* is different (transient features). As shown in FIG. 3, the difference in charging time is related to the values equivalent to resistors R1 to Rn and parasitic capacitances C1 to Cn. Before the LED lights 20-1 to 20-*n* have been sequenced, the equivalent impedance of the LED lights 20-1 to 20-*n* is the first impedance (i.e., the high impedance). The faster the charging time represents the smaller the time constant caused by the transient equivalent impedance of the LED lights 20-1 to 20-*n*, which means that the sequence of the LED lights 20-1 to 20-*n* is more advanced. Therefore, each LED light 20-1 to 20-*n* detects the charging time from self-charging to the first predetermined voltage at the rising edge of the pulse signal Sp. Since the impedance and parasitic capacitance of the LED lights 20-1 to 20-*n* are different, the closer to the LED lights 20-1 to 20-*n* of the control module 10, the faster the charging time will be. In particular, each LED light 20-1 to 20-*n* will be set with the same predetermined time period. In the same rising edge, only the fastest charging time will fall within this predetermined time period. That is, in the same rising edge, only the charging time of the LED lights 20-1 to 20-*n* closest to the control module 10 will fall within this predetermined time period, and this charging time falls within this predetermined time period is the current sequence characteristic.

Figure 7A:
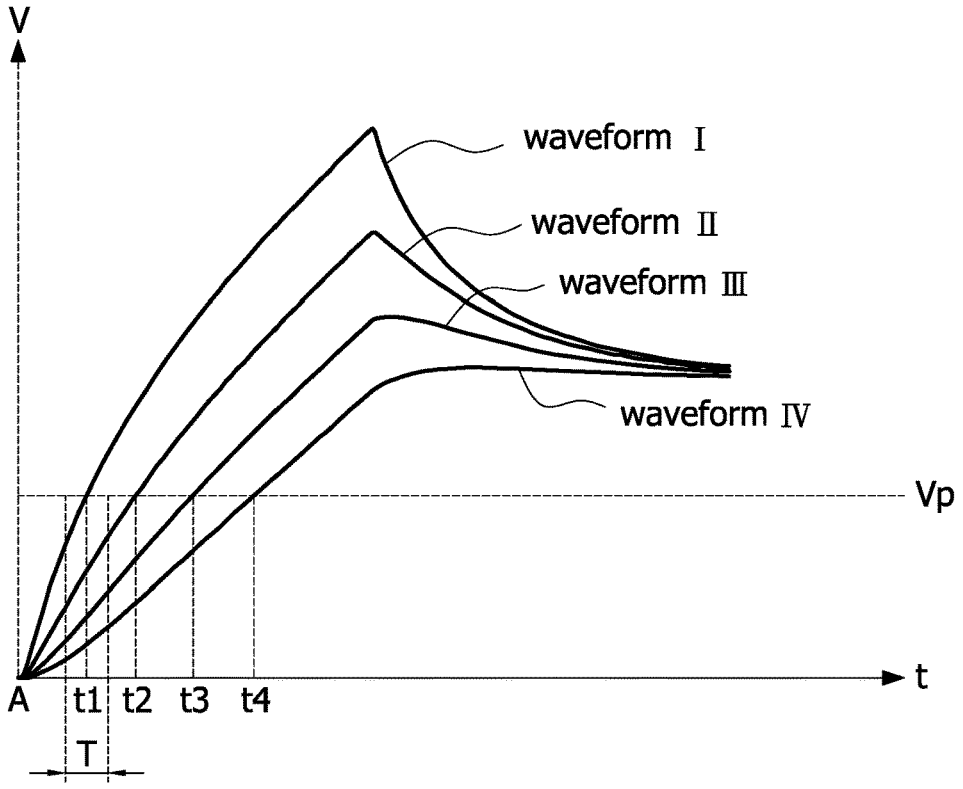
FIG. 7A is a schematic waveform of a charging time at the rising edge of the pulse signal according to a first embodiment of the present disclosure.
Figure 7B:
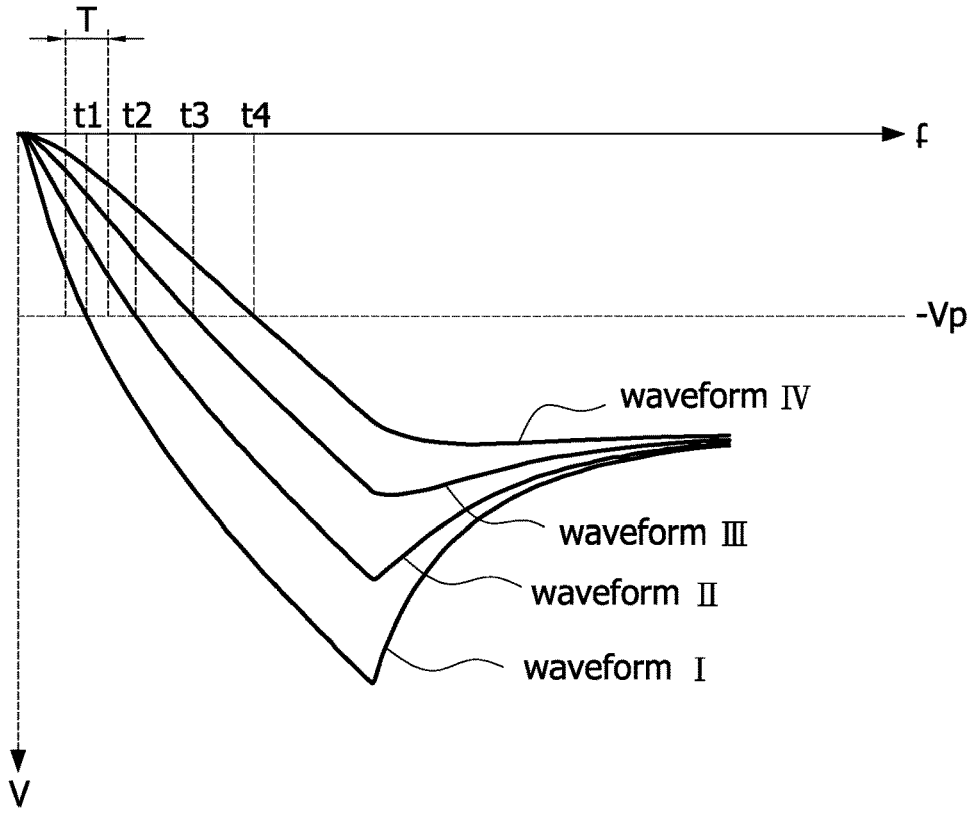
FIG. 7B is a schematic waveform of a charging time at the falling edge of the pulse signal according to a first embodiment of the present disclosure.

Afterward, the LED light corresponding to the charging time falling within the predetermined time period self memorizes the current sequence, or the LED light corresponding to the discharging time falling with the predetermined time period self memorizes the current sequence (S340). Taking the rising edge of the circuit of FIG. 2A as an example, each LED light 20-1 to **20-*n* will be set with the same predetermined time period. In the same rising edge, only the charging time of the LED lights 20-1 to 20-*n* closest to the control module 10 will fall within this predetermined time period. Therefore, when the LED light detects that the self-charging time falls within this predetermined time period, the current sequence is self memorized. The current sequence refers to the LED lights 20-1 to 20-*n* using the pulse number as their sequence. For example, the first pulse is in sequence 1, the second pulse is in sequence 2, and so on. Please refer to FIG. 7A, which shows a schematic waveform of a charging time at the rising edge of the pulse signal according to a first embodiment of the present disclosure, and also refer to FIG. 2A. The first rising edge makes the LED lights 20-1 to 20-*n* produce different voltage waveforms (waveforms I to IV). At time t1, waveform I is charged to the first predetermined voltage Vp, at time t2, waveform II is charged to the first predetermined voltage Vp, at time t3, waveform III is charged to the first predetermined voltage Vp, and at time t4, waveform IV is charged to the first predetermined voltage Vp. Since the waveform I is charged to the first predetermined voltage Vp at time t1, and the time t1 happens to be within the predetermined time period T, the LED lights 20-1 to 20-*n* corresponding to the waveform I are sorted as the first number (i.e., the sequence is 1). The charging time t2 of the waveform II, the charging time t3 of the waveform III, and the charging time t4 of the waveform IV are only time comparisons in this detection, and they are not included in the sorting. Please refer to FIG. 7B, which shows a schematic waveform of a charging time at the falling edge of the pulse signal according to a first embodiment of the present disclosure, and also refer to FIG. 2A. It happens to be the opposite of FIG. 7A, and the waveform I is discharged to a second predetermined voltage −Vp within a predetermined time period is the current sequence characteristic. The rest are the same as those in FIG. 7**A, and will not be repeated here.

Afterward, the LED lights in the current sequence change their states so that they cannot be charged to the first predetermined voltage within a predetermined time period, or the LED lights in the current sequence change their states so that they cannot be discharged to the second predetermined voltage within a predetermined time period (S360). Take the circuit in FIG. 2A at the rising edge as an example. Since the LED lights 20-1 to **20-*n* in the current sequence have self memorized, the LED lights 20-1 to 20-*n* in the current sequence change their impedance from the first impedance to the second impedance (i.e., from the high impedance becomes low impedance). After the impedance of the LED lights 20-1 to 20-*n* in the current sequence is changed to the second impedance, and the second impedance will cause the rising edge of the pulse signal to be provided to the LED lights 20-1 to 20-*n* in the current sequence, the charging time of the current sequence of LED lights 20-1 to 20-*n* becomes shorter. Therefore, after the LED lights 20-1 to 20-*n* in the current sequence are sorted, the charging time of the LED lights 20-1 to 20-*n* in the current sequence will no longer fall within a predetermined time period. Therefore, the LED lights 20-1 to 20-*n* that have been sorted will not be sorted again by mistake. In one embodiment, the remaining undescribed steps and detailed control manners are the same as those of FIG. 4. In addition, in an embodiment of the present disclosure, the steps (S320) to (S380**) at the falling edge of the pulse signal Sp happen to be opposite, which will not be repeated here.

Figure 7C:
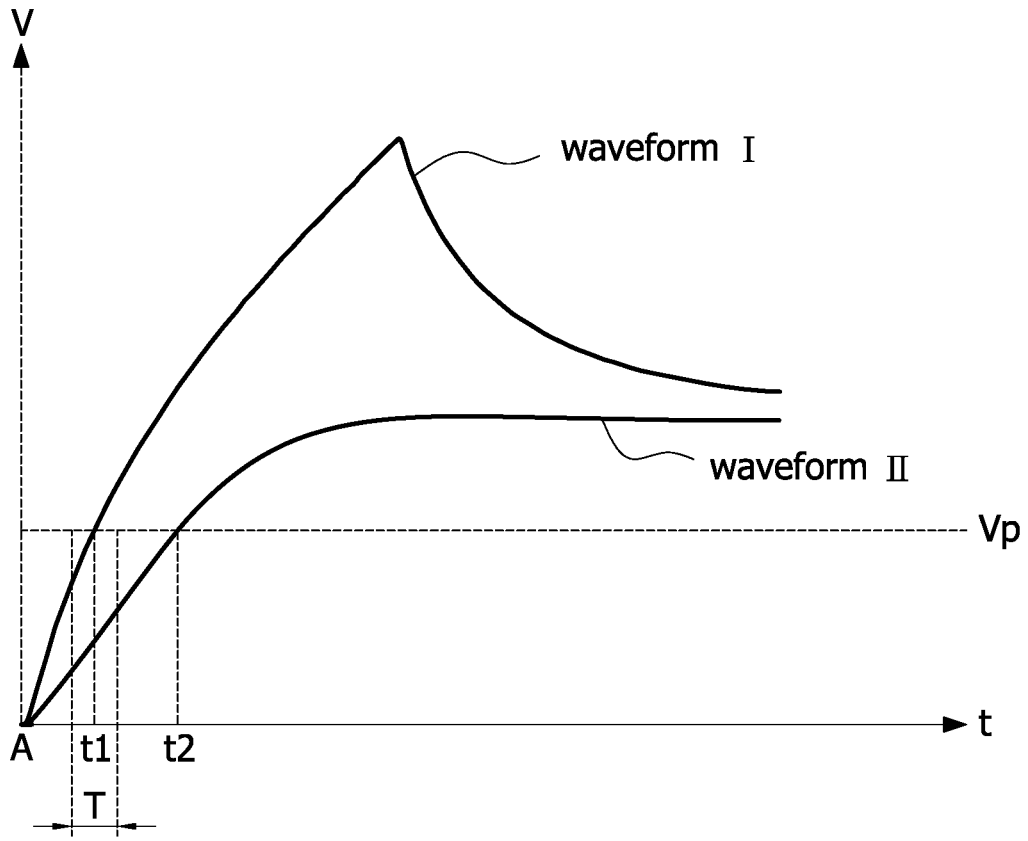
FIG. 7C is a schematic waveform of a charging time at the rising edge of the pulse signal according to a second embodiment of the present disclosure.

Please refer to FIG. 7C, which shows a schematic waveform of a charging time at the rising edge of the pulse signal according to a second embodiment of the present disclosure, and also refer to FIG. 2B. In FIG. 7C, it is assumed that the sequence of the first LED light 20-1' has been completed. At the second rising edge, the charging time t1 of the LED light 20-2' falls within a predetermined time period T (waveform I, that is, sorted as the second number, and the sequence is 2). Since the sequence of the first LED light 20-1' is completed and the first switch Q1 is turned on, at the second rising edge, the first voltage stabilization unit ZD1 in the sequence of the first LED light 20-1' will clamp the LED light 20-1' at the first regulated voltage (waveform II) and the charging time t2 of the LED light 20-1' will not fall within the predetermined time period T. In FIG. 7C, it can be clearly seen that the difference between the waveform II of the first sequence LED light 20-1' and the waveform I of the current sequence LED light 20-2' is changed. This difference may allow the controller 202 to know explicitly whether the self is in the current sequence.

Also refer to FIG. 2A and FIG. 2B, the controller 202 may include a memory unit 202A inside. The memory unit 202A may be a permanent memory type memory unit 202A or a temporary memory type memory unit 202A. Specifically, when the permanent memory type memory unit 202A is powered off (for example, when the output power source Vo is not received or the voltage value of the pulse signal Sp is insufficient), the memory unit 202A still retains the addresses of the corresponding LED lights 20-1 to **20-*n* (i.e., the numbers). Therefore, after the controller 202 is powered off and then powered on again, the memory unit 202A will not lose the addresses of the LED lights 20-1 to 20-*n* so that the control module 10** does not need to perform a sequence procedure again.

Since the LED lights 20-1 to **20-*n* in FIG. 2A are controlled by changing impedance, when the first impedance component Ra is connected in parallel with the second impedance component Rb, and the second impedance is smaller. As a result, in the sequence mode, the voltage drop caused by the rising and falling edges of the pulse signal Sp and the second impedance is small. This makes the voltage drop lower than a demand voltage Vd required for the operation of the memory unit 202A. Therefore, the LED lights 20-1 to 20-*n* in the embodiment of FIG. 2A are adapted to a permanent memory type memory unit 202A, and can use the rising edge and falling edge of the pulse signal Sp to take out the difference between the highest voltage or the charging time for sequencing. When the voltage of the LED lights 20-1 to 20-*n* in sequence is lower than the demand voltage Vd required for the operation of the memory unit 202A, the permanent memory type memory unit 202A can still memorize the sequence of the LED lights 20-1 to 20-*n***.

When the temporary memory type memory unit 202A is powered off (for example, when the output power source Vo is not received or the voltage value of the pulse signal Sp is insufficient), the memory unit 202A cannot retain the addresses of the corresponding LED lights 20-1 to **20-*n* (i.e., the numbers). Therefore, after the controller 202 is powered off, the memory unit 202A loses the addresses of the LED lights 20-1 to 20-*n* so that the control module 10 must perform a sequence procedure again. Therefore, the memory unit 202A must receive the demand voltage Vd required for operation at any time. Since the LED lights 20-1' to 20-*n*' in FIG. 2B are controlled using a regulated voltage, when the first switch Q1 is turned on, the voltage across the LED lights 20-1' to 20-*n*' is the first regulated voltage. Therefore, the first regulated voltage can still meet the demand voltage Vd required for the operation of the memory unit 202A. The LED lights 20-1' to 20-*n*' of the embodiment of FIG. 2B are suitable for the temporary memory type memory unit 202A (the permanent memory type memory unit 202A is also compatible, but the cost performance ratio of the temporary memory type memory unit 202A is higher). Since the first voltage stabilization unit ZD1 has directivity, the LED lights 20-1' to 20-*n*' in FIG. 2**B can only use the rising edge of the pulse signal Sp to take out the difference in the highest voltage or the charging time for sequencing.

Figure 8:
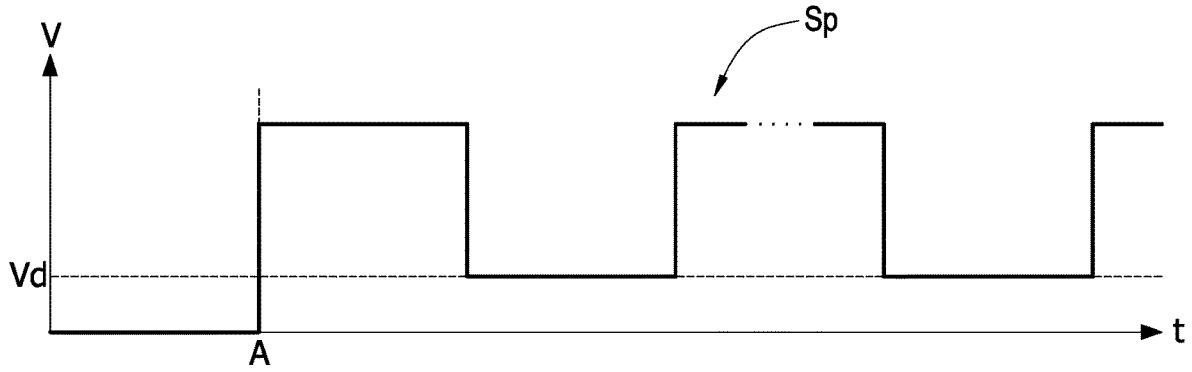
FIG. 8 is a waveform of a temporary memory type memory unit according to the present disclosure.

Please refer to FIG. 8, which shows a waveform of a temporary memory type memory unit according to the present disclosure, and also refer to FIG. 1 to FIG. 7C. Since the memory unit 202A must receive the working voltage at any time, the voltage value of the pulse signal Sp received at the low level of the sequence procedure of the LED light string 20 cannot be reduced to too low (for example but not limited to zero volt). Except for the first rising edge of the pulse signal Sp, the subsequent signals, regardless of the high level or low level, must still be higher than the demand voltage Vd required for the operation of the memory unit 202A so as to avoid the memory unit 202A from forgetting the addresses of the respective LED lights 20-1 to **20-*n*. In one embodiment, the starting point A of the rising edge shown in FIG. 8 is the same point in FIG. 5A to FIG. 5C and FIG. 7A to FIG. 7C. In other words, when the starting point A of the rising edge of the pulse signal Sp waveform in FIG. 8 is at the same point A in FIG. 5A to FIG. 5C, the controller 202 will obtain a waveform of a transient voltage spike. When the starting point A of the rising edge of the pulse signal Sp waveform in FIG. 8 is at the same point A in FIG. 7A to FIG. 7C, the controller 202** will obtain a curve of capacitive charging from point A.

Figure 9:
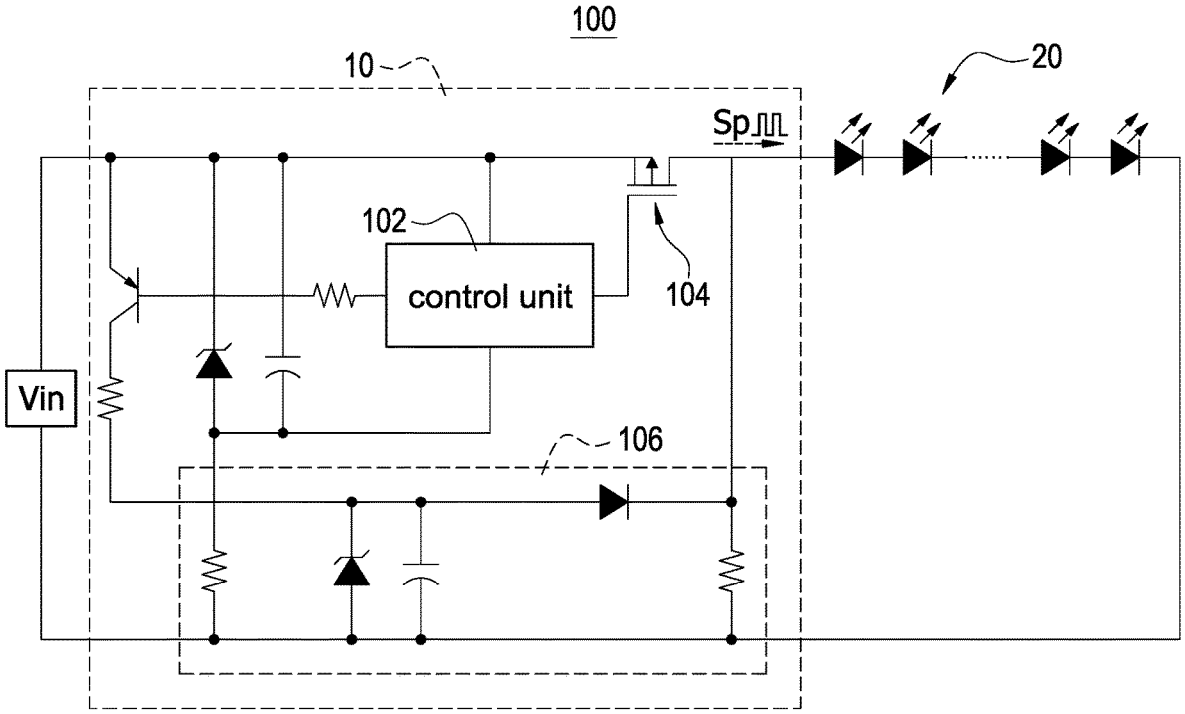
FIG. 9 is a circuit diagram of the LED light string system according to the present disclosure.

Please refer to FIG. 9, which shows a circuit diagram of the LED light string system according to the present disclosure, and also refer to FIG. 1 to FIG. 8. The control module 10 of the LED light string system 100 includes a control unit 102, a switching switch 104, and a level maintain unit 106. The control unit 102 receives an input power source Vin. The switching switch 104 is coupled to the input power source Vin, the control unit 102, and an LED light string 20. The control unit 102 controls the switching of the switching switch 104 to switch the input power source Vin into a pulse signal Sp. The level maintain unit 106 is coupled to the input power source Vin and the switching switch 104. When the changeover switch 104 is turned off (i.e., the switching signal provided by the control unit 102 to the switching switch 104 is at a low level), the voltage of the input power source Vin is clamped at the demand voltage through the level maintain unit 106 (shown in FIG. 8) so that the voltage value of the pulse signal Sp at the low level is maintained at the demand voltage required for the operation of the memory unit 202A. In one embodiment, the LED light string system 100 may not necessarily require the level maintain unit 106. The control unit 102 can continuously switch the pulse signal Sp between high level and low level through the switching switch 104, and the energy saving and dormant design of the controller 202 makes the voltage value of the pulse signal Sp at a low level not lower than the demand voltage. For example but not limited to, when the level is switched, the pulse signal Sp is controlled by a high level and a slow discharge drop to achieve the effect that the voltage value of the switching switch 104 when it is turned off (that is, at a low level) will not be lower than the demand voltage.

What is claimed is:

1. A method of sequencing an LED light string, comprising steps of:

(a) using a control module to provide a pulse signal to an LED light string having a plurality of LED lights, (b) obtaining a current sequence characteristic of the LED light string, by a controller in an LED light, at a first rising edge or a first falling edge of the pulse signal, (c) self memorizing, by the controller in the LED light, as a current sequence, and changing a self state of the controller in the LED light, by a status adjustment unit in the LED light, so that the current sequence characteristic is no longer generated, and (d) repeating to perform step (b) and (c) at next rising edge or next falling edge of the pulse signal so as to obtain the sequence of the LED lights.

2. The method of sequencing an LED light string in claim 1, wherein the current sequence characteristic is a highest voltage or a lowest voltage; when a surge voltage generated by the LED light at the rising edge of the pulse signal is higher than the surge voltage of the remaining LED lights, the surge voltage of the LED light is the highest voltage; or when the surge voltage generated by the LED light at the falling edge of the pulse signal is lower than the surge voltage of the remaining LED lights, the surge voltage of the LED light is the lowest voltage.

3. The method of sequencing an LED light string in claim 1, wherein the current sequence characteristic is a predetermined time period; a charging time at which the LED light is charged to a first predetermined voltage at the rising edge of the pulse signal is faster than the charging time of the remaining LED lights, the charging time of the LED light falls within the predetermined time period; or a discharging time at which the LED light is discharged to a second predetermined voltage at the falling edge of the pulse signal is faster than the discharging time of the remaining LED lights, the discharging time of the LED light falls within the predetermined time period.

4. The method of sequencing the LED light string in claim 1, wherein each LED light comprises a capacitor; the rising edge or the falling edge of the pulse signal causes the transient features generated by the capacitor of each LED light to be different.

5. The method of sequencing the LED light string in claim 1, wherein each LED light comprises the controller having a memory unit; when the LED light string is powered off and the memory unit is powered off, the memory unit still memorizes addresses of the LED lights.

6. The method of sequencing the LED light string in claim 1, wherein the LED light changes impedances, by the status adjustment unit in the LED light, from a first impedance to a second impedance to change the self state of the LED light, and when the last LED light of the LED light string has not changed from the first impedance to the second impedance, the value of the first impedance of the ending LED light is greater than the sum of the second impedance of each of the remaining LED lights.

7. The method of sequencing the LED light string in claim 1, wherein the LED light is clamped to a regulated voltage at the rising edge of the pulse signal to change the self state of the LED light.

8. The method of sequencing the LED light string in claim 1, further comprising a step of:

(e) providing, by the control module, a reset signal to the LED light string so that the LED light string is resorted, and returning to step (b).

9. The method of sequencing the LED light string in claim 5, wherein each LED light comprises the controller having the memory unit; when a voltage value of the pulse signal at a low level is still higher than a demand voltage required for the operation of the memory unit, the memory unit still memorizes addresses of the LED lights.

10. A self-sequencing LED light, comprising:

a controller having an input end and an output end, and the input end receiving a pulse signal, a light-emitting component coupled to the controller, and a status adjustment unit coupled in parallel to the controller, wherein, when the LED light in a sequence mode and the controller obtains a current sequence characteristic at the rising edge or the falling edge of the pulse signal, the controller is configured to self memorize as a current sequence and provide a status adjustment signal to the status adjustment unit to change a self state of the controller; when the LED light is in a working mode, the controller is configured to control the light-emitting component to emit light according to the pulse signal.

11. The self-sequencing LED light in claim 10, wherein the status adjustment unit comprises:

a first impedance component coupled in parallel to the controller, a second impedance component coupled to the first impedance component, and a first switch coupled to the second impedance component and the controller, wherein, when the first switch does not receive the status adjustment signal, the first switch is turned off, and the first impedance component is coupled in parallel to the controller so that the controller is a first impedance; when the first switch receives the status adjustment signal, the first switch is turned on, and the first impedance component is coupled in parallel to the second impedance component and the controller so that the controller is a second impedance.

12. The self-sequencing LED light in claim 10, wherein the status adjustment unit comprises:

a first impedance component coupled in parallel to the controller, a first voltage-stabilizing unit coupled to the first impedance component, and a first switch coupled to the first voltage-stabilizing unit and the controller, wherein, when the first switch does not receive the status adjustment signal, the first switch is turned off, and the first impedance component is coupled in parallel to the controller so that the controller is a first impedance; when the first switch receives the status adjustment signal, the first switch is turned on, and the first impedance component is coupled in parallel to the first voltage-stabilizing unit and the controller so that the controller clamps a first regulated voltage on the rising edge of the pulse signal.

13. The self-sequencing LED light in claim 12, wherein when the first switch does not receive a mode control signal provided by the controller, the first switch is turned off so that the controller enters the sequence mode; when the first switch receives the mode control signal, the first switch is turned on and the first voltage-stabilizing unit clamps the controller to the first regulated voltage so that the controller enters the working mode.

14. The self-sequencing LED light in claim 10, further comprising:

a capacitor coupled in parallel to the controller, wherein, in the sequence mode, the capacitor generates a surge voltage through the rising edging or the falling edge of the pulse signal and a charging time to charge to a first predetermined voltage, or the capacitor generates the surge voltage through the falling edge of the pulse signal and a discharging time to discharge to a second predetermined voltage.

15. The self-sequencing LED light in claim 10, further comprising:

a mode control unit comprising:

a second voltage-stabilizing unit coupled to the controller, and a second switch coupled to the second voltage-stabilizing unit and the controller, wherein, when the second switch does not receive a mode control signal provided by the controller, the second switch is turned off so that the controller enters the sequence mode; when the second switch receives the mode control signal, the second switch is turned on and the second voltage-stabilizing unit clamps the controller to a second regulated voltage so that the controller enters the working mode.

16. The self-sequencing LED light in claim 10, wherein the controller further comprises:

a memory unit configured to memorize an address of the controller.

17. A self-sequencing LED light string system, comprising:

a control unit coupled to an input power source, a switching switch coupled to the control unit, and an LED light string coupled to the switching switch, and comprises a plurality of LED lights in series, wherein each LED light comprises:

a controller having an input end and an output end, and the input end receiving a pulse signal, a light-emitting component coupled to the controller, and a status adjustment unit coupled in parallel to the controller, wherein, the control unit is configured to control the switching switch to switch the input power source to hg pulse signal, and the LED light string is configured to perform self-sequencing of the LED lights according to the pulse signal; or the LED lights are controlled to emit light according to the pulse signal; and wherein when the LED light in a sequence mode and the controller obtains a current sequence characteristic at the rising edge or the falling edge of the pulse signal, the controller is configured to self memorize as a current sequence and provide a status adjustment signal to the status adjustment unit to change a self state of the controller; when the LED light is in a working mode, the controller is configured to control the light-emitting component to emit light according to the pulse signal.

18. The self-sequencing LED light string system in claim 17, further comprising:

a level maintain unit coupled to the input power source and the switching switch, wherein, when the switching switch is turned off, the level maintain unit is configured to maintain a voltage value of the pulse signal at a demand voltage.

* * * * *